US005654595A

United States Patent [19]

Ferguson

[11] Patent Number: 5,654,595

[45] Date of Patent: Aug. 5, 1997

[54] ELECTRICAL CURRENT REGULATING DEVICE FOR A POWER TOOL

[76] Inventor: Thomas R. Ferguson, 47 Pebble River Cir., Sacramento, Calif. 95831

[21] Appl. No.: 366,684

[22] Filed: Dec. 29, 1994

[51] Int. Cl.[6] ..... H01H 9/06

[52] U.S. Cl. ..... 307/139; 307/112; 307/119; 307/140; 200/61.85; 200/334; 192/116.5; 192/125 A

[58] Field of Search ..... 307/119, 112, 307/140, 149, 150, 139, 125; 408/8; 192/116.5, 125 A; 200/332.2, 334, 61.85

[56] References Cited

U.S. PATENT DOCUMENTS

| | | | |
|---|---|---|---|
| 1,589,977 | 10/1926 | Lucas . | |
| 2,357,690 | 9/1944 | Rugheimer | 77/6 |
| 2,422,755 | 6/1947 | Strother | 192/129 |
| 4,135,068 | 1/1979 | Burns | 200/61.85 |
| 4,376,240 | 3/1983 | Stuart | 200/327 |
| 4,463,228 | 7/1984 | Osika | 200/51 R |
| 4,530,624 | 7/1985 | Cuneo | 408/9 |
| 4,543,723 | 10/1985 | Bortfeld et al. | 30/381 |
| 4,970,355 | 11/1990 | Haeusslein et al. | 200/50 B |
| 5,415,264 | 5/1995 | Bessette | 192/130 |
| 5,455,735 | 10/1995 | Zerega | 361/189 |

*Primary Examiner*—William M. Shoop, Jr.
*Assistant Examiner*—Albert W. Paladini
*Attorney, Agent, or Firm*—John P. Costello

[57] ABSTRACT

A device for regulating the flow of electrical current to a power tool includes a switch and handle combination coupled to a wiring component which serves to bypass an electrical circuit of a power tool. In a first embodiment, the wiring component can be "hard wired" into the electrical circuit of a power tool in a permanent arrangement. In a second embodiment, the wiring component is self-contained, and includes a power cord bisected by a junction box, the junction box for accepting the plug adaptor of a power tool. An anchoring device serves to anchor the switch and handle to an accessible location upon the power tool, so that the switch may be easily reached, should a user need to increase, decrease, reverse or stop the flow of electrical current to the power tool motor.

2 Claims, 2 Drawing Sheets

ELECTRICAL CURRENT REGULATING DEVICE FOR A POWER TOOL

BACKGROUND OF THE INVENTION

1. Field of the Invention

This invention pertains generally to the field of safety devices for electrical power tools and, more specifically, to a device for regulating the flow of electrical current to a power tool.

2. Description of the Background Art

The use of power tools has significantly increased the level of efficiency with regard to the time and amount of labor required to build a variety of products. However, the benefits provided by power tools has not been without costs, as numerous industrial accidents resulting from power tools are reported each year. As a result, a number of safety devices have been created to help avoid accidents relating to the use of power tools.

One safety solution has been to create devices which regulate the flow of electrical current to a power tool, by either diminishing the amount of current, thus slowing the tool, or else stopping the flow of current, thereby stopping the tool, completely. In this manner, should the power tool become stuck in a work piece, or else present some other danger, the electrical power can be readily slowed, or cut off, thereby diminishing the danger presented by the tool. A typical example of this type of solution is seen in the spring-activated cut-off switches, which are built into most hand held power tools, such as hand drills and radial saws. The cut off switches built into these tools, efficiently cut power to these tools, should there be a need to do so.

In large, stationary, industrial power tools, such as lathes and drill presses, a variety of power cut off devices have also been devised. U.S. Pat. No. 2,357,690, issued to J. P. Rugheimer, discloses a drill press equipped with a power cut off switch which toggles between an "on" and an "off" position, upon being bumped by the drill press sleeve. U.S. Pat. No. 1,589,977, issued to A. Lucas, discloses a spring-activated cut off switch for a welding machine. U.S. Pat. No. 4,135,068, issued to Burns, discloses a cut off switch assembly for a sand blaster, which can be coupled to the sand blaster by a pair of clamps.

Many industrial power tools are manufactured with switches of a "toggle" variety, as mentioned previously, in the Rugheimer patent, which must be manually switched between an "on" and an "off" position. Moreover, many of these toggle switches are not positioned for easy access, should it become immediately necessary to cut the power to a tool. U.S. Pat. No. 4,530,624, issued to Cuneo, proposes a solution to this access problem by locating a power switch on the end of a drill press handle. However, the device disclosed in Cuneo is of a built-in variety and therefore cannot be used to adapt to an existing industrial tool lacking a power regulating switch.

A need therefore exists for a device which can convert an existing industrial tool lacking a power regulating switch, into a safer tool which incorporates such a switch. The present invention satisfies this need, as well as overcomes the deficiencies of the devices heretofore developed.

The foregoing discussion and patents mentioned herein, reflect the state of the art of which the applicant is aware and are tendered with the view toward discharging applicant's acknowledged duty of candor in disclosing information which may be pertinent to the examination of this application. It is respectfully stipulated, however, that none of these patents teach or render obvious, singly or when considered in combination, applicant's claimed invention.

SUMMARY OF THE INVENTION

According to the present invention, the foregoing and other objects and advantages are attained by providing a device for regulating the flow of electrical current to a power tool, which includes a handle/switch combination and a wiring component coupled to the handle/switch combination. The switch component of the handle/switch combination may be of any type which allows the flow of power to be increased, decreased, reversed, or stopped completely.

In accordance with one aspect of the invention, the device may be designed to be coupled permanently to the power tool, thereby providing a safety device which is incorporated into the power tool.

In accordance with another aspect of the invention, the wiring component may be designed to be separate from the power tool by being composed of a power cord having two halves which couple to the top and bottom of a junction box. In this arrangement, the first half of the power cord is further coupled at its end opposite of the junction box to the handle/switch combination, while the second half of the power cord has a simple plug adaptor, for plugging into a common electrical outlet, coupled to its end opposite of the junction box. Hence, the user needs only to couple the plug adaptor of the device to an outlet, and, subsequently, couple the plug adaptor of a power tool to the junction box, to make the device operational, thus providing the user with a readily adaptable device for regulating the flow of electric current to any power tool.

In accordance with another aspect of the invention, a device for anchoring the handle/switch combination to a location on the power tool is contemplated. In one embodiment, this anchoring device may be a set of clamps, or the like, coupled to a support plate. A threaded spacer with two opposing ends is coupled to the handle at its first end, and the support plate at its second end. This threaded spacer provides an adjustable means for providing an appropriate amount of space between the handle and the support plate, for a user's hand.

Also in accordance with the invention, the handle can have an ergonomic shape for comfortably accommodating a user's hand during extended periods of use.

It is an object of the invention to provide a device for effectively regulating the flow of electrical current to a power tool for purposes of safety.

Another object of the invention is to provide a device for regulating the flow of electrical current to a power tool that can be readily adapted to any power tool lacking such a power-regulating device.

Still other objects and advantages of the device described herein will become readily apparent to those skilled in this art from the following detailed description, wherein only the preferred embodiment of the device has been shown and described, simply by way of illustration of the best mode contemplated for carrying out the invention. As will be realized, the electrical current regulating device of the present invention, is capable of other and different embodiments and its several details are capable of modifications in various obvious respects, all without departing from the invention. Accordingly, the drawings and description are to be regarded as illustrative in nature, and not as restrictive.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
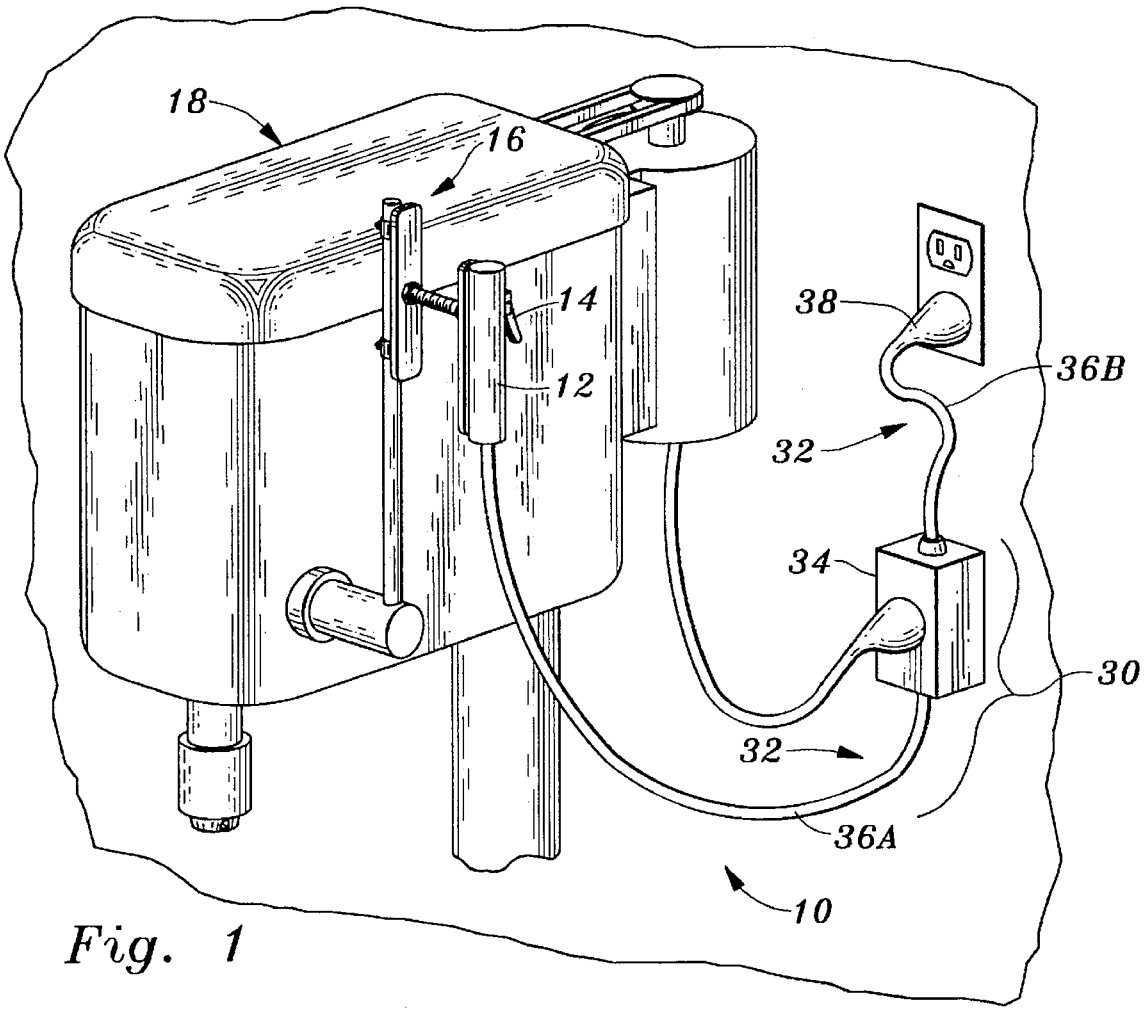
FIG. 1 is a perspective view of the preferred embodiment of the electrical current regulating device of the present invention, coupled to a drill press.
Figure 2:
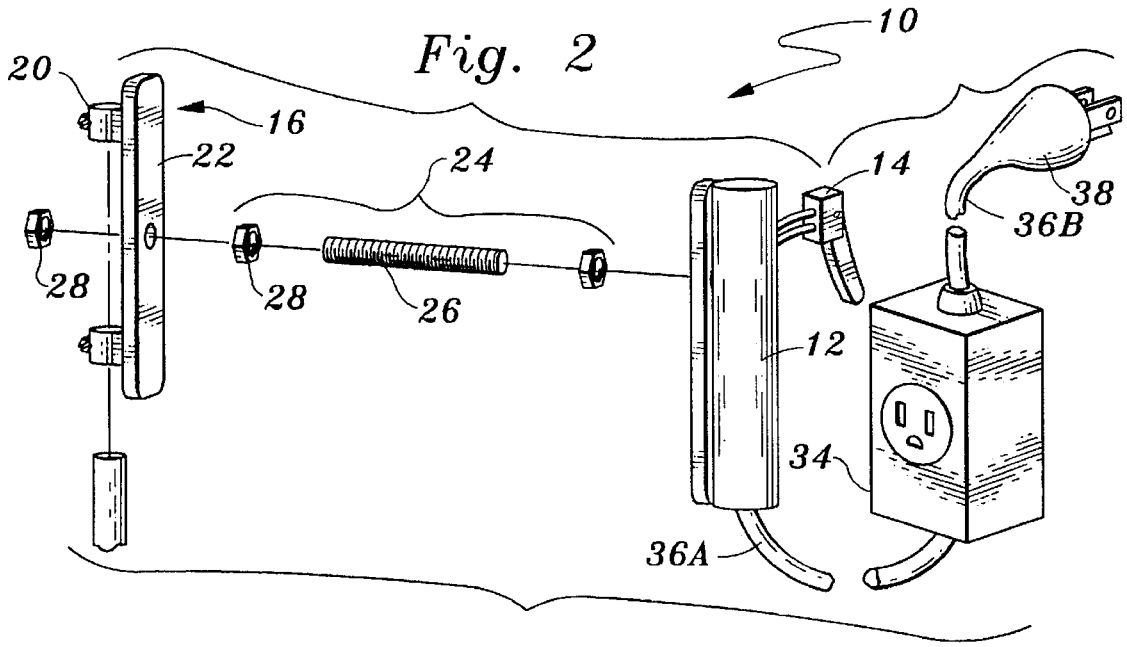
FIG. 2 is an exploded view of the electrical current regulating device of the present invention, shown in condensed format.
Figure 3:
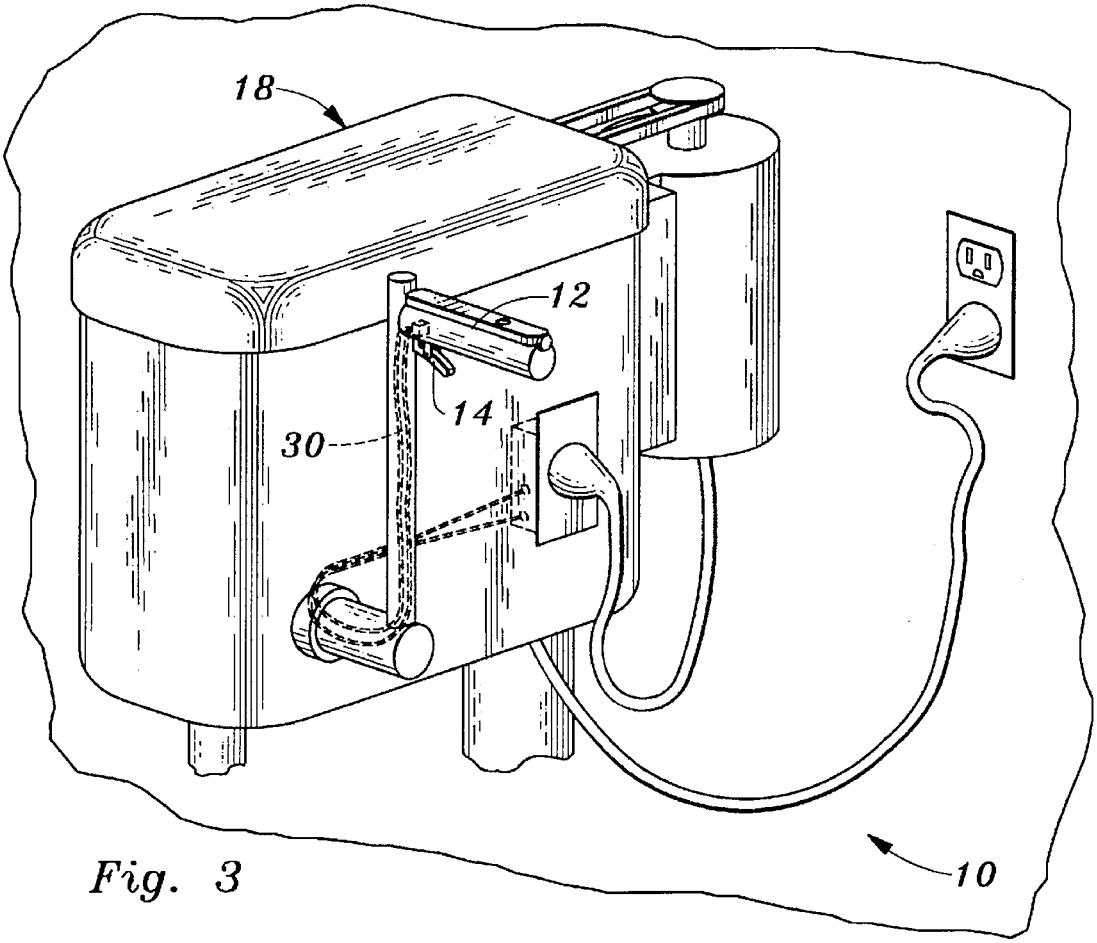
FIG. 3 is a perspective view of an alternate embodiment of the present invention, this embodiment being coupled permantly to the drill press shown.

Referring more specifically to the drawings, for illustrative purposes, the present invention is embodied in the electrical current regulating device 10 generally shown in FIGS. 1, 2 and 3. It will be appreciated that device 10 may vary as to configuration and as to details of the parts, without departing from the basic concepts as disclosed herein.

Figure 4:
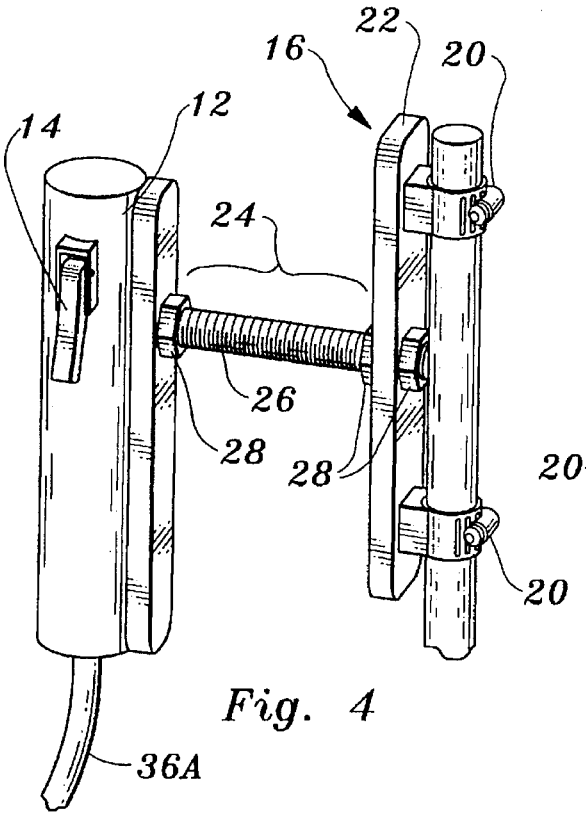
FIG. 4 is a closeup perspective view of the handle and switch components of the present invention, coupled to the anchoring device which in turn is coupled to the handle of a power tool.

Device 10 includes a handle 12 with a switch 14 coupled thereupon at a position easily accessible to a user. Anchoring device 16 is coupled to handle 12 and provides a reliable means for anchoring handle 12 to a power tool 18 such as a drill press. Anchoring device 16 can be any device which efficiently and solidly couples handle 12 to a power tool 18 in an immovable manner. For example, a pair of ring clamps 20 soldered to a support plate 22 serves as an efficient anchoring device 16 for coupling to the handle of a power tool 18, such as a drill press, as is clearly shown in FIGS. 1 and 4. Although the drill press shown has a single handle, the invention is adaptable to drill presses having more than one handle, such as the three-spoke handles common on many drill presses.

It is desirable for handle 12 and anchoring device 16 to be separated by a spacer 24, spacer 24 allowing room for a user to place his hand. Spacer 24 is preferably horizontally adjustable, to allow for the distance between handle 12 and anchoring device 16 to be varied, depending on the size of a user's hand. Spacer 24 can be a threaded bolt 26 having two ends, and nut 28, wherein bolt 26 extends through handle 12 and anchoring device 16. Nuts 28 can be adjusted to a preferred spacing by a user, and subsequently tightened around anchoring device 16 or handle 12, once the proper spacing has been reached. FIG. 3 shows the second embodiment having handle 12 coupled to power tool 18, in a different orientation, without the aid of spacer 24. This second embodiment is permanently attached to the power tool and it may therefore be desirable to weld handle 12 to power tool 18 rather than employ a detachable anchoring device 16.

Handle 12 may be hollow or solid in its construction, but must be sturdy enough to endure the repetitive tasks imposed upon the average power tool. For example, if anchoring device 16 was coupled to a drill press, handle 12 would serve as a secondary handle for operating the drill press, and would have to be of a strength sufficient for surviving the thousands of drilling tasks performed by a drill press. Handle 12 preferably has a location for grounding switch 14 thereupon.

Referring again to FIGS. 1, 2, and 3, and also to FIG. 1A, the wiring component 30 of this invention is clearly shown. FIGS. 1, 1A, and 2, illustrate the independently wired embodiment of the invention and FIG. 3 illustrates the second, permanently wired embodiment, discussed previously. In practice, both embodiments regulate the flow of electrical current to a power tool identically, however, the independently wired embodiment is independent of the power tool, and can be plugged into, and unplugged from a power tool, at will. In this way, the independently wired embodiment can be adapted to any power tool lacking the safety features which this invention provides.

Wiring component 30 is comprised of a power cord 32 and junction box 34, wherein power cord 32 joins junction box 34 at its top and bottom. Power cord 30 thereby protrudes from junction box 34 as a first half 36A and a second half 36B. First half 36A joins handle 12 and switch 14 at its end opposite of junction box 34. Second half 36B likewise joins plug adaptor 38 at its end opposite of junction box 34.

Referring closely to FIG. 1A, a wiring diagram is shown which illustrates how switch 14 regulates the flow of electrical current through wiring component 30. This diagram shows the preferred arrangement within device 10 of hot wire 40, neutral wire 42, and ground wires 44, which comprise power cord 32. As shown, hot wire 40, which carries electrical current, is diverted first to switch 14, and then, secondly, continues on from switch 14 to junction box 34. In this manner, rather than connecting hot wire 40, directly to junction box 34, the diversion of hot wire 40 to switch 14, effectively bypasses junction box 34. This diversion of hot wire 40 through switch 14 allows the electrical current flowing through hot wire 40 to be regulated by switch 14. By alternately closing or opening switch 14, the electrical current flowing to outlet box 34 is likewise started and stopped. In this manner, a power tool which is plugged into outlet box 34 will start, slow down, or stop, depending on whether switch 14 is closed, partially closed, or opened, respectively.

Figure 5:
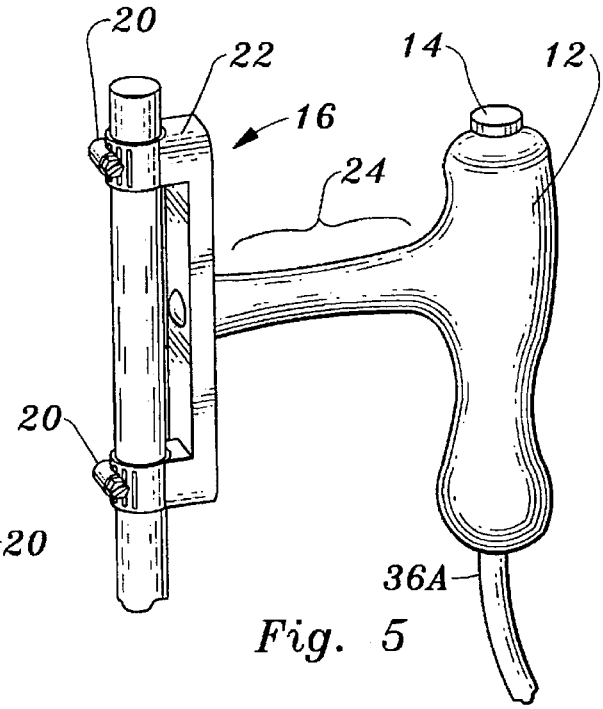
FIG. 5 is a closeup perspective view of the handle and switch components of the present invention, configured in an ergonomic shape, where the switch is designed as a button placed on the end of the handle.

Handle 12 of device 10 may be formed in an ergonomic manner, as shown in FIG. 5, which would allow device 10 to be used comfortably throughout many repetitive tasks. Additionally, switch 14 can be an easily depressible button placed upon the end of handle 12, if preferred.

Accordingly, it will be seen that this invention provides for a device which allows the passage of electrical current to a power tool to be regulated. Depending on the type of switch selected for use with the invention, the electric current passing to the power tool can be slowed, increased, reversed or stopped. The regulation of the amount of current passing to a power tool will allow a user to increase or decrease the speed of the tool, as well as reverse or stop the tool completely. By regulating the amount of current, and thereby the speed and/or direction of the tool, the device described herein allows any power tool to incorporate a high measure of safety by allowing a power tool to be slowed, reversed or stopped, should a dangerous situation present itself.

Although the description above contains many specificities, these should not be construed as limiting the scope of the invention, but as merely providing illustrations of some of the presently preferred embodiments of this invention. Thus the scope of this invention should be determined by the appended claims and their legal equivalents.

I claim:

1. A device for regulating a flow of electrical current to a power tool, consisting of:

a) handle means for providing a hand hold;

b) a switch coupled to said handle means, said switch interrupting said flow of electrical current to said power tool;

c) anchor means for anchoring said handle means to said power tool; and d) a junction box having first and second power cord halves continuing outward from said junction box;

e) said first power cord half coupled to said switch, said second power cord half terminating at a plug adaptor; and f) a spacer for spacing said anchor means a defined distance in a horizontal plane from said handle means, said spacer means coupled between said anchor means and said handle means.

2. A device for converting an existing power tool lacking a power regulating switch, into a safer tool incorporating such a switch, comprising:

a) handle means for providing a hand hold;

b) a switch coupled to said handle means, said switch interrupting a flow of electrical current to said power tool;

c) anchor means for anchoring said handle means to a power tool;

d) a threaded spacer having two ends, wherein a first of said ends is adjustably coupled to said handle means, and wherein a second of said ends is adjustably coupled to said anchor means, said spacer for adjustably spacing said anchor means a horizontal distance from said handle means; and e) a power cord and junction box, wherein a first half of said power cord continues from a first end of said junction box and terminates at a plug adaptor, and wherein a second half of said power cord continues from a second end of said junction box and terminates at said switch.

* * * * *